US005199581A

United States Patent [19]

Arnold

[11] Patent Number: 5,199,581

[45] Date of Patent: Apr. 6, 1993

[54] GOLF EQUIPMENT SUPPORT RACK

[75] Inventor: William D. Arnold, Florissant, Mo.

[73] Assignee: Lee Rowan Company, St. Louis, Mo.

[21] Appl. No.: 862,350

[22] Filed: Apr. 2, 1992

[51] Int. Cl.[5] ..... A47F 7/00

[52] U.S. Cl. ..... 211/106; 211/87; 248/96

[58] Field of Search ..... 211/106, 34, 35, 70.2, 211/87, 88; 248/96

[56] References Cited

U.S. PATENT DOCUMENTS

| | | | |
|---|---|---|---|
| D. 312,437 | 12/1990 | Martinell et al. . | |
| 379,152 | 3/1888 | Clemens | 211/106 |
| 694,793 | 3/1902 | Schiele | 211/106 |
| 846,758 | 3/1907 | Pike | 211/87 X |
| 887,972 | 5/1908 | Sloan | 211/106 |
| 1,233,001 | 7/1917 | Tuohimaa | 211/106 |
| 1,386,775 | 8/1921 | Fulford | 211/87 |
| 2,205,099 | 6/1940 | Lentz | 211/35 |
| 2,295,886 | 9/1942 | Beck | 211/35 |
| 3,659,722 | 5/1972 | Canoll | 211/106 |

*Primary Examiner*—Robert W. Gibson, Jr.
*Attorney, Agent, or Firm*—Rogers, Howell & Haferkamp

[57] ABSTRACT

A golf equipment support rack generally comprising metal wire elements welded together including a pair of wire elements bent to form golf bag hangers. These golf bag hangers are horizontally spaced and provide removable and upright support for a pair of golf bags by means of their upper carrying-strap rings. This golf equipment support rack also has a continuous wire loop bent to form side walls for preventing the golf bags from pivoting too freely and too far outwardly. This golf equipment support rack also has two wire elements bent to form golf shoe supports for two pair of shoes.

24 Claims, 2 Drawing Sheets

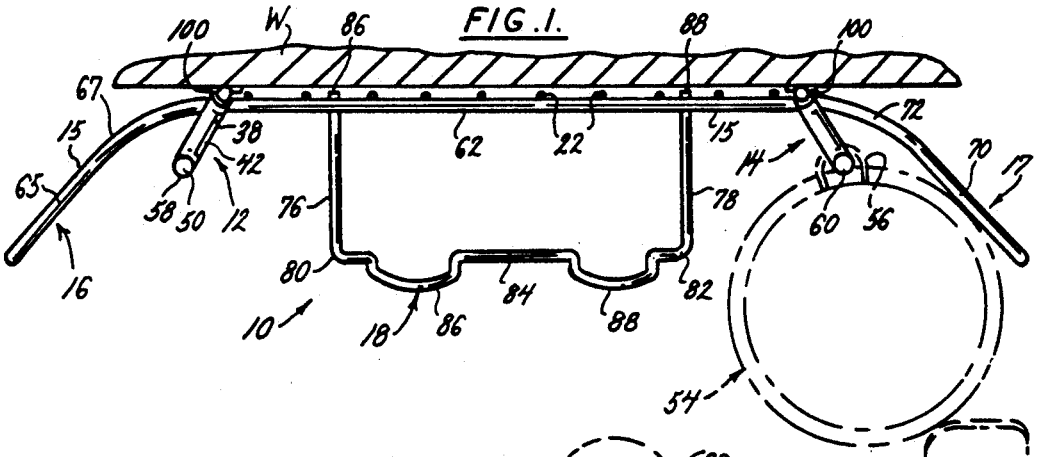
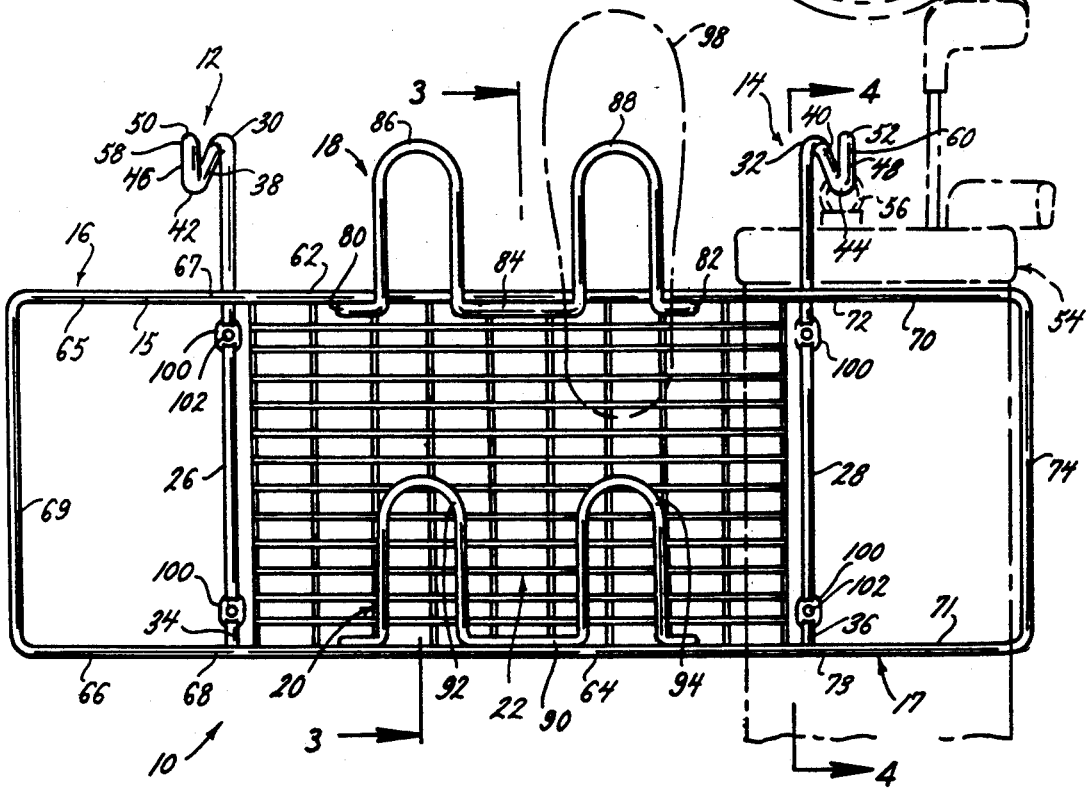
FIG. 2.

FIG. 3.
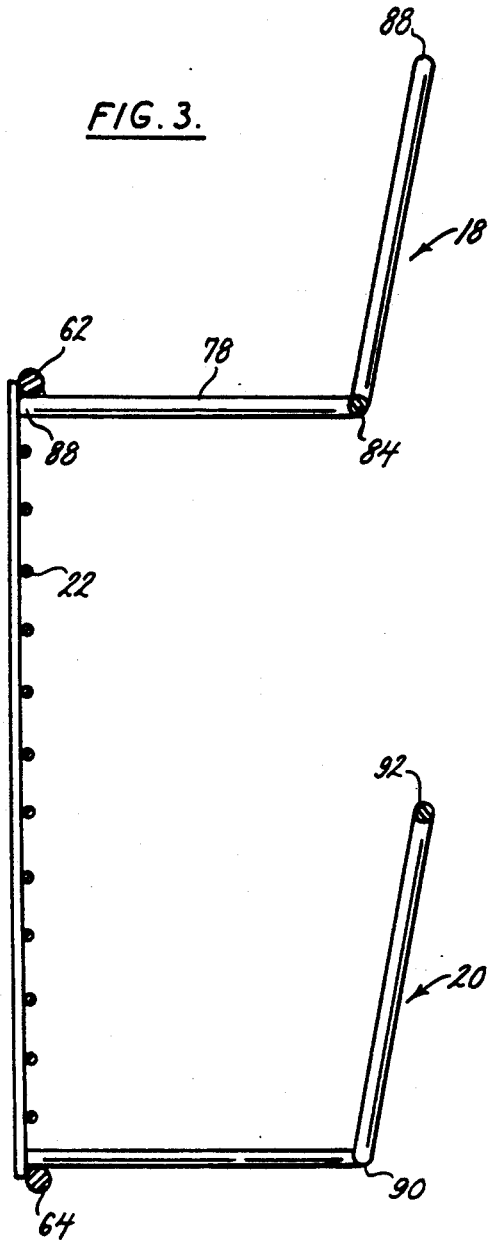
FIG. 4.
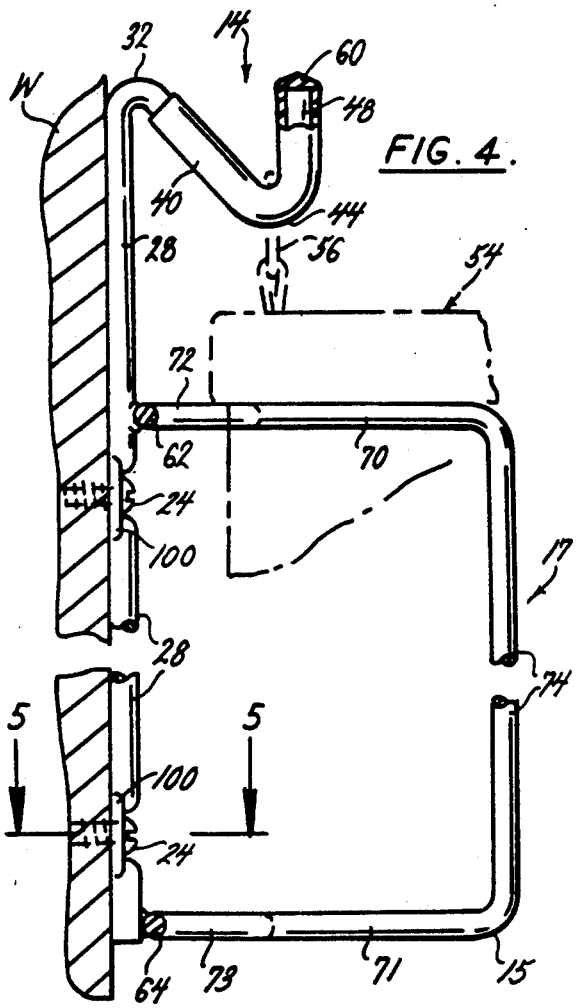
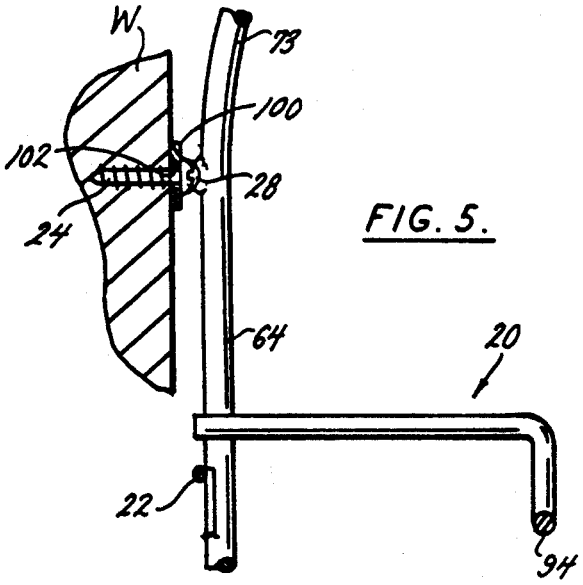
FIG. 5.

GOLF EQUIPMENT SUPPORT RACK

BACKGROUND AND SUMMARY OF THE INVENTION

The present invention relates to a golf equipment support rack and particularly to a golf equipment support rack for mounting to a wall and for removably and uprightly supporting a pair of golf bags.

Golf bag hangers are known in the art. A bag is usually hung by its upper carrying strap ring, and that ring is located near the open top of the bag and cooperates with a lower ring to anchor a strap strung between the rings. The known hangers typically comprise a finger projecting forwardly and upwardly from a wall support for removable support of golf bags by their upper carrying strap rings.

The present invention is an improvement on the golf bag hangers of the prior art. Advantages of the present invention include a fixed frame made of metal wire elements welded together, a pair of wire elements bent to form a pair of golf bag hangers, and a continuous wire loop bent to form side walls for preventing the golf bags from pivoting too freely and too far outwardly. In addition, two wire elements are each bent to form golf shoe supports for two pair of shoes. This fixed frame of wire elements has proven to be advantageous because it is made of fewer and less costly components and is fabricated according to less costly methods. As a result, the fixed frame weighs little and is inexpensive to ship. These and more advantages are provided by the present invention without sacrificing strength, appearance, or convenience of use.

In accordance with the present invention, a golf equipment support rack comprises metal wire elements welded together including a pair of wire elements bent to form golf bag hangers. These golf bag hangers are horizontally spaced and provide removable and upright support for a pair of golf bags from their upper carrying-strap rings. This golf equipment support rack also has a continuous wire loop bent to form side walls for preventing the golf bags from pivoting too freely and too far outwardly. This golf equipment support rack also has two wire elements, each bent to form golf shoe supports for two pair of shoes.

BRIEF DESCRIPTION OF THE DRAWINGS

FIG. 1 is a top plan view of a golf equipment support rack of the present invention with a golf bag shown in broken lines to illustrate the removable support thereof.

FIG. 2 is a front elevation view of the golf equipment support rack with a golf shoe and a section of a golf bag shown in broken lines for illustrative purposes only.

FIG. 3 is an enlarged sectional view taken generally along the line 3—3 of FIG. 2 with a golf shoe shown in broken lines for illustrative purposes only.

FIG. 4 is an enlarged sectional view, with portions broken away, taken generally along the line 4—4 of FIG. 2 with a section of a golf bag shown in broken lines for illustrative purposes only.

FIG. 5 is a sectional view taken generally along the line 5—5 of FIG. 4.

DESCRIPTION OF THE PREFERRED EMBODIMENT

This golf equipment support rack 10 is generally a fixed frame comprising metal wire elements welded together, including a pair of wire elements bent as will be described to form golf bag hangers 12 and 14, a continuous wire loop 15 bent as will be described to form side walls 16 and 17, and two wire elements bent as will be described to form golf shoe supports 18 and 20. In addition, the golf equipment support rack 10 includes a grill 22 of criss-crossed wires which is sized as will be described to make a wall protector. The wall protector 22 and the golf shoe supports 18 and 20 are welded to the continuous wire 16, which in turn is welded to the horizontally spaced golf bag hangers 12 and 14. The resulting integral golf equipment support rack 10 is thus readily attachable to a wall W, or like mounting structure, by screws 24, or like fasteners.

The wire elements 12 and 14 that define the golf bag hangers include vertical segments 26 and 28, which have upper bent ends 30 and 32 and lower terminal ends 34 and 36. Inclined segments 38 and 40 extend forwardly, downwardly, and a little outwardly from and have rearward ends joined to the upper bent ends 30 and 32, and have forward bent ends 42 and 44. Generally vertical segments 46 and 48 extend upwardly from and have lower ends joined to the forward bent ends 42 and 44, and have upper terminal ends 50 and 52. In use, the inclined and generally vertical segments 38 and 46 of wire 12, 40 and 48 of wire 14, define golf bag hangers for removably and uprightly supporting golf bags 54 by means of the upper carrying-strap rings 56, as generally illustrated in FIG. 2. For protection from scratches, the hooks defined by the inclined and generally vertical segments 38 and 46 of wire 12, and 40 and 48 of wire 14, are covered by boots 58 and 60 of neoprene rubber or the like.

The continuous wire element 15 that defines the side walls 16 and 17 includes upper and lower horizontal central segments 62 and 64. The side wall 16 is defined by upper and lower wire segments 65 and 66 joined by arcuate segments 67 and 68 to the central segments 62 and 64, respectively, and by an outer vertical segment 69 continuous with and extending between the segments 65 and 66. The opposite side wall 17 is similarly formed by upper and lower wire segments 70 and 71 joined to the central segments 62 and 64 by arcuate segments 72 and 73, respectively, and by an outer vertical segment 74 continuous with and extending between the segments 70 and 71. The side walls 16 and 17, formed from the continuous wire element 16 as described above, provide surface portions against which a golf bag can come to pivotal rest, as illustrated in FIG. 1, so that the golf bag is prevented from pivoting too freely or too far outwardly, and is aligned more upright, as generally illustrated in FIG. 2.

Identical wire elements 18 and 20 that define upper and lower golf shoe supports are bent to form loops. The wire element 18 that defines the upper golf shoe support comprises spaced horizontal wire elements 76 and 78 welded to and extending forward from the upper central wire segment 62. These horizontal wire elements end at bends 80 and 82, and a shoe support wire segment 84 extends between the bends 80 and 82. Two open, upwardly and rearwardly extending shoe support loops 86 and 88 are formed in the wire segment 84, as shown in FIGS. 1 and 2. The wire element 20 that defines the lower golf shoe support has a form identical to the wire element 18, is correspondingly welded to and extending forward of the lower wire segment 64 and similarly has a wire segment 90 in which two upwardly and rearwardly extending shoe support loops 92 and 94 are formed. A golf shoe 98 can be removably supported by any of the inverted U-shaped shoe support loops 86, 88, 92 or 94 as generally illustrated in FIG. 2.

The vertical segments 26 and 28 of the golf bag hangers 12 and 14 are horizontally spaced and generally parallel with one another. The vertical segments 26 and 28 are formed with a pair of flat portions 100, and are provided with a pair of fastener holes 102 through the flat portions 100. The vertical segments 26 and 28 are so horizontally spaced that the fastener holes 102 have about sixteen (16) inches between centers. Thus the fastener holes 102 are so horizontally spaced as to permit the location of screws 24 on standard wall studs (not shown).

The grill 22 of criss-crossed wires that defines the wall protector extends between and has upper and lower edge margins welded to the upper and lower segments 62 and 64 of the continuous wire 16, as illustrated in FIG. 2, and provides general protection for the wall W.

While the present invention has been described by reference to a specific embodiment, it should be understood that modifications and variations of the invention may be constructed without departing from the scope of the invention defined in the following claims.

What is claimed is:

1. A golf equipment support rack for attaching to the front of a mounting structure, comprising:

two horizontally spaced first means for removably and uprightly supporting two golf bags in a horizontally spaced relationship;

second means for restricting angular, outward revolution of golf bags about the first means; and third means for attaching to the mounting structure and for securely supporting the first and second means.

2. The golf equipment support rack of claim 1 wherein each first means comprises an elongated hook-shaped member which extends generally forwardly from and has a first end securely supported by said third means, and has an exposed second end;

each of said hook-shaped members is for removably supporting a golf bag by its upper carrying-strap ring.

3. The golf equipment support rack of claim 2 wherein the third means includes a pair of horizontally spaced, elongated vertical segments which have upper and lower ends; and each of said hook-shaped members extends generally forwardly from and has said first end joined to one of said upper ends.

4. The golf equipment support rack of claim 3 wherein the pair of elongated vertical segments of the third means are each provided with fastener holes, and said pair of segments are so horizontally spaced as to have about 16 inches between fastener hole centers 5. The golf equipment support rack of claim 1 wherein the second means comprises an intermediate portion, and opposite and horizontally spaced end portions projecting forwardly of the intermediate portion.

6. The golf equipment support rack of claim 1 wherein the second means comprises:

at least one horizontal and non-linear elongate member which has a generally straight portion with opposite ends; and a pair of end portions which include a bending portion and which generally extend outwardly and forwardly from and have inner ends joined to the ends of said straight portion, and which have outward ends.

7. The golf equipment support rack of claim 6 wherein the second means further comprises:

a pair of vertical elongate members which extend upwardly from and have lower ends joined to said outward ends, and which have upper ends; and a second horizontal and non-linear elongate member which is identical to said one horizontal and non-linear elongate member, and which extends between and has outer ends joined to said upper ends.

8. The golf equipment support rack of claim 7 wherein the second means is a continuous metal wire.

9. The golf equipment support rack of claim 8 wherein the third means is metallic and securely supports the second means by means of welded joints.

10. A golf equipment support rack for attaching to the face of a mounting structure, comprising:

two horizontally spaced first members having forwardly projecting hanger sections for removably and uprightly supporting golf bags by their upper carrying-strap rings;

at least one second member having an intermediate portion with two edges and horizontally-spaced, opposite side portions which extend generally forwardly from and have inner edges joined to said opposite edges and provide surfaces for preventing the golf bag lower ends from pivoting outwardly; and first means for attaching to the mounting structure and for securely supporting the first and second members.

11. The golf equipment support rack of claim 10 wherein the second member further comprises a pair of generally parallel vertical segments with opposite ends and a pair of non-linear, horizontal segments extending between and merging with the opposite ends of said vertical segments.

12. The golf equipment support rack of claim 11 wherein the second member is a continuous metal wire.

13. The golf equipment support rack of claim 12 wherein said first means is metallic and securely supports the second member by means of welded joints.

14. The golf equipment support rack of claim 13 wherein said first means comprises two vertical metal wire elements; and said two metal wire elements are provided with fastener holes and disposed on the second member so as to have about 16 inches between the fastener hole centers of the respective two metal wire elements.

15. The golf equipment support rack of claim 14 further comprising:

second means supported by said first means for removably and uprightly supporting a pair of golf shoes.

16. The golf equipment support rack of claim 15 wherein said second means comprises a metal wire loop for supporting each shoe, and is securely supported by said second member by means of welded joints.

17. A golf equipment support rack comprising:

a wire frame including upper and lower generally horizontal wire arm elements defined by top, bottom and side wire elements;

at least two wire hooks supported by the wire arms each for engaging a loop on a golf bag to suspend two golf bags from two said wire hooks, and a wire member supported by a wire arm element and having shoe retaining projections for retaining a pair of shoes.

18. The golf equipment support rack of claim 17 wherein:

the wire arm elements are bent to provide central sections and lateral wing portions extending forward from the central sections, the hooks being inward of the lateral wing portions.

19. The golf equipment support rack of claim 17 wherein the wire arm elements are portions of a continuous wire loop having vertical side sections, the lateral wing portions having outer ends joined to respective ones of the vertical side sections to complete the continuous wire loop.

20. The golf equipment support rack of claim 17 wherein the wire hooks are on the upper ends of generally vertical rods that cross and are welded to the wire arm elements at their crossing points.

21. The golf equipment support rack of claim 20 wherein the generally vertical rods are spaced by about 16 inches and have flattened areas with holes through them to facilitate mounting to studs of standard wall spacing.

22. The golf equipment support rack of claim 17 wherein:

the wire member is supported by the upper wire arm element; and a second wire member is supported by the lower wire arm element and having shoe retaining portions for retaining a second pair of shoes.

23. The golf equipment support rack of claim 22 wherein:

the wire members are vertically aligned and project forward from the wire arm elements; and the wire members are located inward of the wire hooks and function as inward stops against which the inner sides of golf bags can bear when hung on the wire hooks.

24. The golf equipment support rack of claim 23 wherein:

the wire arm elements have left and right outer portions bent forward to serve as outer stops against which the outer sides of golf bags can bear when hung on the wire hooks.

* * * * *